US007199333B2

(12) United States Patent
Alphandary

(10) Patent No.: US 7,199,333 B2
(45) Date of Patent: Apr. 3, 2007

(54) BRANDING IRON

(76) Inventor: Adi Alphandary, 19 Hashmonaim Street, Hod Hasharon (IL) 45245

( * ) Notice: Subject to any disclaimer, the term of this patent is extended or adjusted under 35 U.S.C. 154(b) by 94 days.

(21) Appl. No.: 11/033,393

(22) Filed: Jan. 12, 2005

(65) Prior Publication Data

US 2005/0166769 A1 Aug. 4, 2005

Related U.S. Application Data

(60) Provisional application No. 60/535,500, filed on Jan. 12, 2004.

(51) Int. Cl.

| | |
|---|---|
| ***B44B 7/02*** | (2006.01) |
| ***H05B 3/30*** | (2006.01) |
| ***H05B 3/20*** | (2006.01) |
| ***H05B 3/06*** | (2006.01) |

(52) U.S. Cl. ..... 219/237; 219/221; 219/227; 219/231; 219/240; 101/31; 101/25; 101/29

(58) Field of Classification Search ..... 219/233, 219/227, 240, 235, 228, 229, 221; 101/31, 101/25, 29

See application file for complete search history.

(56) References Cited

U.S. PATENT DOCUMENTS

| | | | | |
|---|---|---|---|---|
| 1,871,555 | A * | 8/1932 | Pearce | 219/230 |
| 3,379,176 | A * | 4/1968 | Propst | 606/116 |
| 4,906,815 | A * | 3/1990 | Yarrington | 219/233 |

* cited by examiner

*Primary Examiner*—Robin Evans
(74) *Attorney, Agent, or Firm*—Mark M Friedman

(57) ABSTRACT

A personalized branding iron with interchangeable symbols, including: a handle arrangement having a first end and a second end; a mounting arrangement mechanically connected to the first end; and at least one unitary substantial symbol configured for branding. The mounting arrangement and the symbol are configured for convenient mechanical connection of the symbol to the mounting arrangement.

12 Claims, 11 Drawing Sheets

BRANDING IRON

This application claims priority from U.S. Provisional Application No 60/535,500 filed Jan. 12$^{th}$, 2004.

FIELD AND BACKGROUND OF THE INVENTION

The present invention relates to branding and, in particular, it concerns a branding iron having interchangeable symbols.

Branding irons are used by a chef to brand cooked meat or fowl with a symbol either identifying the chef by name or initials, the name or initials of a restaurant, the type of meat or fowl, or how well it has been cooked, for example, M for medium and R for rare. Such branding irons are particularly popular for use with home barbecues. The head of the iron includes symbols thereon, which are heated up over an open fire or grill until the head is very hot. Once the head is hot enough, the iron can then be used to brand a piece of meat or fowl without using dye on the meat or fowl.

Branding irons are ordered specially from the manufacturer who welds the selected letters, numerals or symbols to the branding iron. Typically, the user needs to wait two or three weeks or more to receive a personalized branding iron.

Additionally, as the symbols are in fixed position relative to the handle of the branding iron, the branding iron is generally difficult to use during heating and/or branding.

Therefore, there is a need for a branding iron that can be purchased as a kit, including an iron assembly and symbols of choice, for convenient assembly, as well as a branding iron which is more convenient to use during both heating and branding.

SUMMARY OF THE INVENTION

The present invention is a branding iron construction and method of operation thereof.

According to the teachings of the present invention there is provided, a personalized branding iron, comprising: (a) a handle arrangement having a first end and a second end; (b) a mounting arrangement mechanically connected to the first end; and (c) at least one unitary substantial symbol configured for branding, the mounting arrangement and the symbol being configured for convenient mechanical connection of the symbol to the mounting arrangement.

According to a further feature of the present invention, the mounting arrangement and the symbol are configured for convenient reversible mechanical connection of the symbol to the mounting arrangement.

According to a further feature of the present invention, there is also provided an electric heating element disposed adjacent to the mounting arrangement, the electric heating element being configured for heating the at least one symbol.

According to a further feature of the present invention, there is also provided a pin for the convenient mechanical attachment of the symbol to the mounting arrangement.

According to a further feature of the present invention, the symbol is one of a letter or a numeral.

According to a further feature of the present invention, there is also provided a manual actuator, wherein the mounting arrangement is mechanically connected to the first end of the handle arrangement such that the mounting arrangement swivels with respect to the handle between a branding position and a heating position, the manual actuator being mechanically connected to the handle arrangement and the mounting arrangement, the manual actuator being configured for moving the mounting arrangement between the branding position and the heating position.

According to a further feature of the present invention, the manual actuator includes a lever arrangement extending from the mounting arrangement to the second end of the handle.

According to a further feature of the present invention, the handle arrangement has a direction of elongation, the symbol having a branding surface defining a plane, the plane being parallel to the direction of elongation in the heating position, the plane being perpendicular to the direction of elongation in the branding position.

According to the teachings of the present invention there is also provided a branding iron, comprising: (a) a handle arrangement having a first end and a second end; (b) a mounting arrangement being configured for mechanical connection to at least one symbol configured for branding, the mounting arrangement being mechanically connected to the first end of the handle arrangement such that the mounting arrangement swivels with respect to the handle between a branding position and a heating position; and (c) a manual actuator mechanically connected to the handle arrangement and the mounting arrangement, the manual actuator being configured for moving the mounting arrangement between the branding position and the heating position.

According to a further feature of the present invention, there is also provided an electric heating element disposed adjacent to the mounting arrangement, the electric heating element being configured for heating the at least one symbol.

According to a further feature of the present invention, the manual actuator includes a lever arrangement extending from the mounting arrangement to the second end of the handle.

According to a further feature of the present invention, the handle arrangement has a direction of elongation, the symbol having a branding surface defining a plane, the plane being parallel to the direction of elongation in the heating position, the plane being perpendicular to the direction of elongation in the branding position.

According to the teachings of the present invention there is also provided a branding iron, comprising: (a) a handle arrangement having a first end and a second end; (b) at least one symbol configured for branding; (c) a mounting arrangement mechanically connected to the symbol, the mounting arrangement being mechanically connected to the first end of the handle arrangement such that the mounting arrangement swivels with respect to the handle between a branding position and a heating position; and (d) a manual actuator mechanically connected to the handle arrangement and the mounting arrangement, the manual actuator being configured for moving the mounting arrangement between the branding position and the heating position.

According to a further feature of the present invention, there is also provided an electric heating element disposed adjacent to the mounting arrangement, the electric heating element being configured for heating the at least one symbol.

According to a further feature of the present invention, the manual actuator includes a lever arrangement extending from the mounting arrangement to the second end of the handle.

According to a further feature of the present invention, the handle arrangement has a direction of elongation, the symbol having a branding surface defining a plane, the plane being parallel to the direction of elongation in the heating position, the plane being perpendicular to the direction of elongation in the branding position.

BRIEF DESCRIPTION OF THE DRAWINGS

The invention is herein described, by way of example only, with reference to the accompanying drawings, wherein:

FIG. 5 is an isometric view of the mounting arrangement of the branding iron of FIG. 3 having letters attached there to;

FIG. 8 is an isometric view of the mounting arrangement of the branding iron of FIG. 3 having a symbol attached there to;

DESCRIPTION OF THE PREFERRED EMBODIMENTS

The present invention is a branding iron construction and method of operation thereof.

The principles and operation of a branding iron according to the present invention may be better understood with reference to the drawings and the accompanying description.

By way of introduction, the present invention teaches a branding iron which has symbols that are configured for convenient reversible attachment to the branding iron assembly without welding. Typically, the retailer sells the branding iron assembly and symbols separately for assembly, generally by the customer at home. Therefore, the user is able to purchase a branding iron having the desired symbols for substantially immediate use. Additionally, the user is able to interchange symbols on the same branding iron assembly, thereby making the product more economical. Also, maintenance is made easier by being able to remove the symbols for cleaning, for example, but not limited to putting the symbols in a dishwasher. The branding iron optionally includes features whereby the branding surface of the symbols are configured for being rotated with respect to the iron handle for ease of use during heating and branding, as will be described below in more detail.

The branding iron is typically used for branding cooked meat and fowl. However, it will be appreciated by those ordinarily skilled in the art that the branding iron of the present invention can also be used for branding other items, for example, but not limited to, wood, leather and animals.

Figure 1:
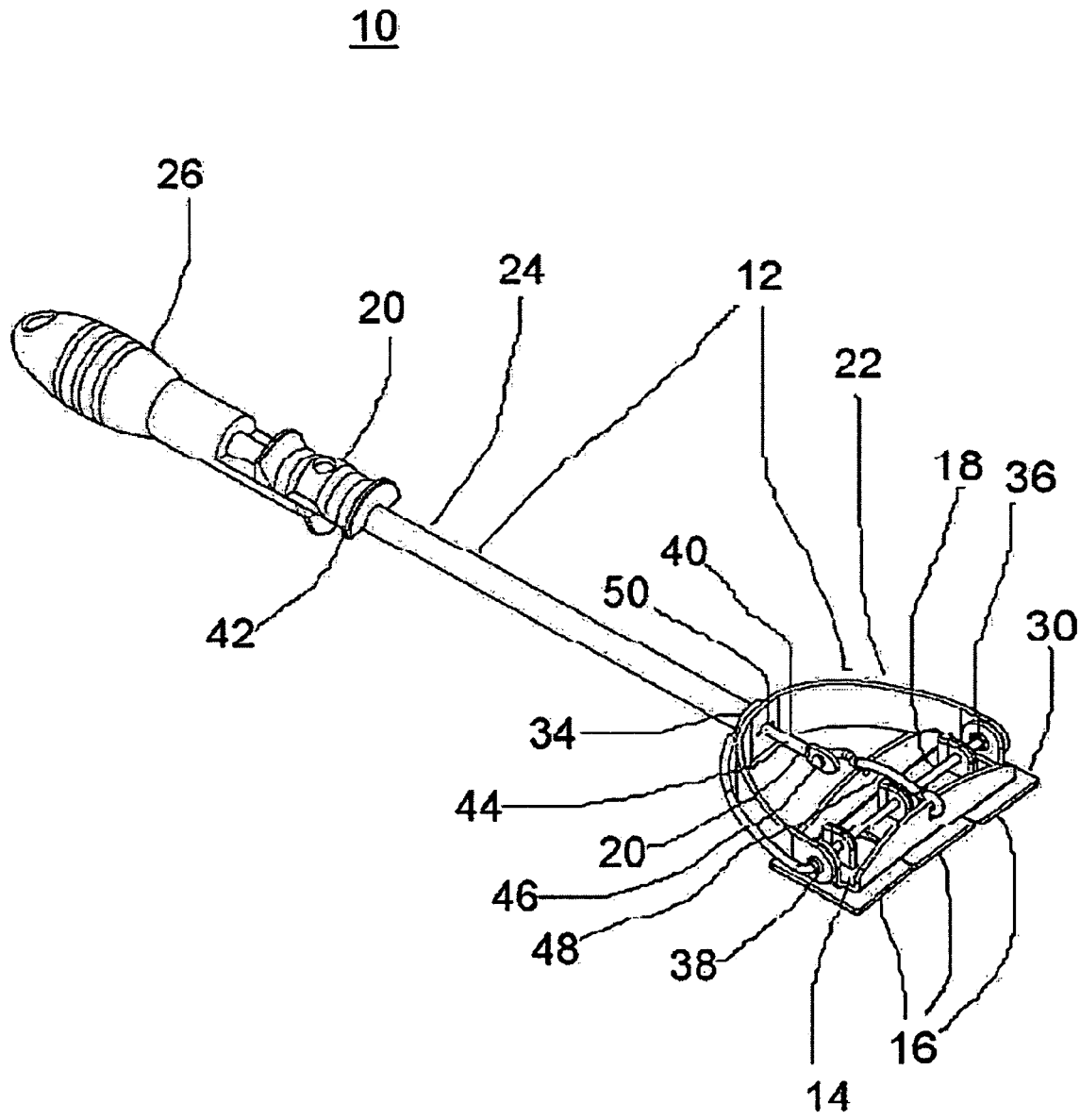
FIG. 1 is an isometric view of a branding iron, in a heating position, that is constructed and operable in accordance with a preferred embodiment of the invention.
Figure 2:
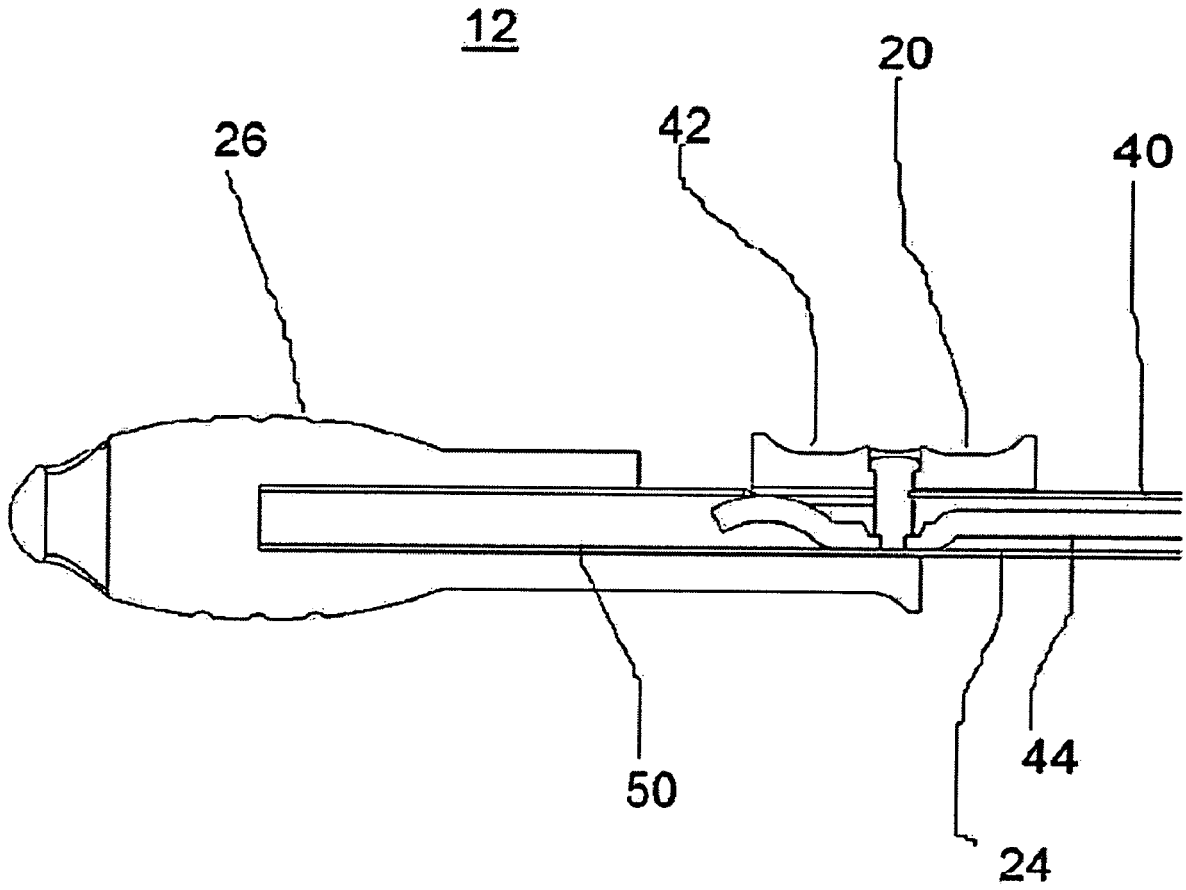
FIG. 2 is an axial cross-sectional view of the handle of the branding iron of FIG. 1.
Figure 3:
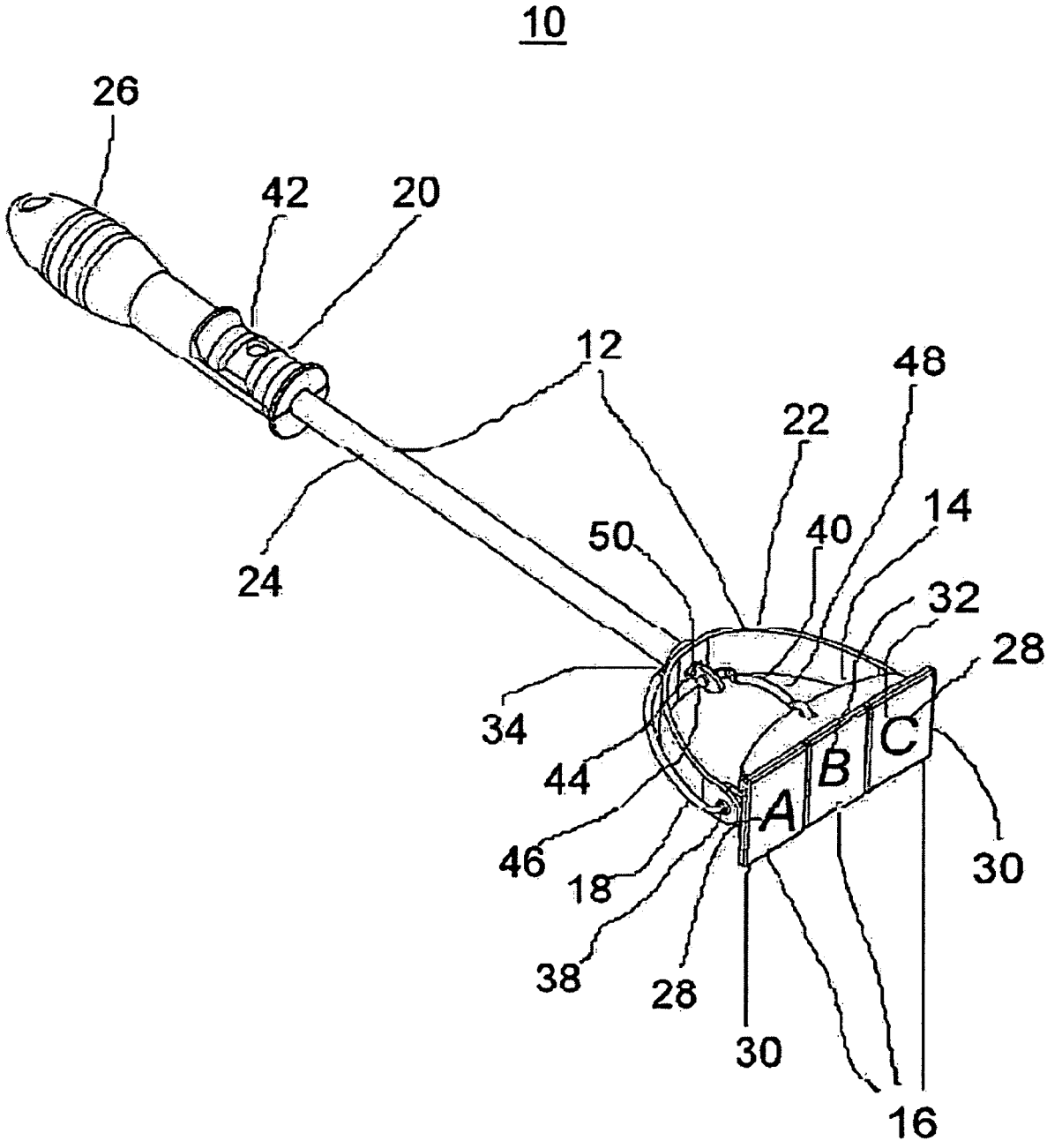
FIG. 3 is an isometric view of the branding iron of FIG. 1 in a branding position.
Figure 4:
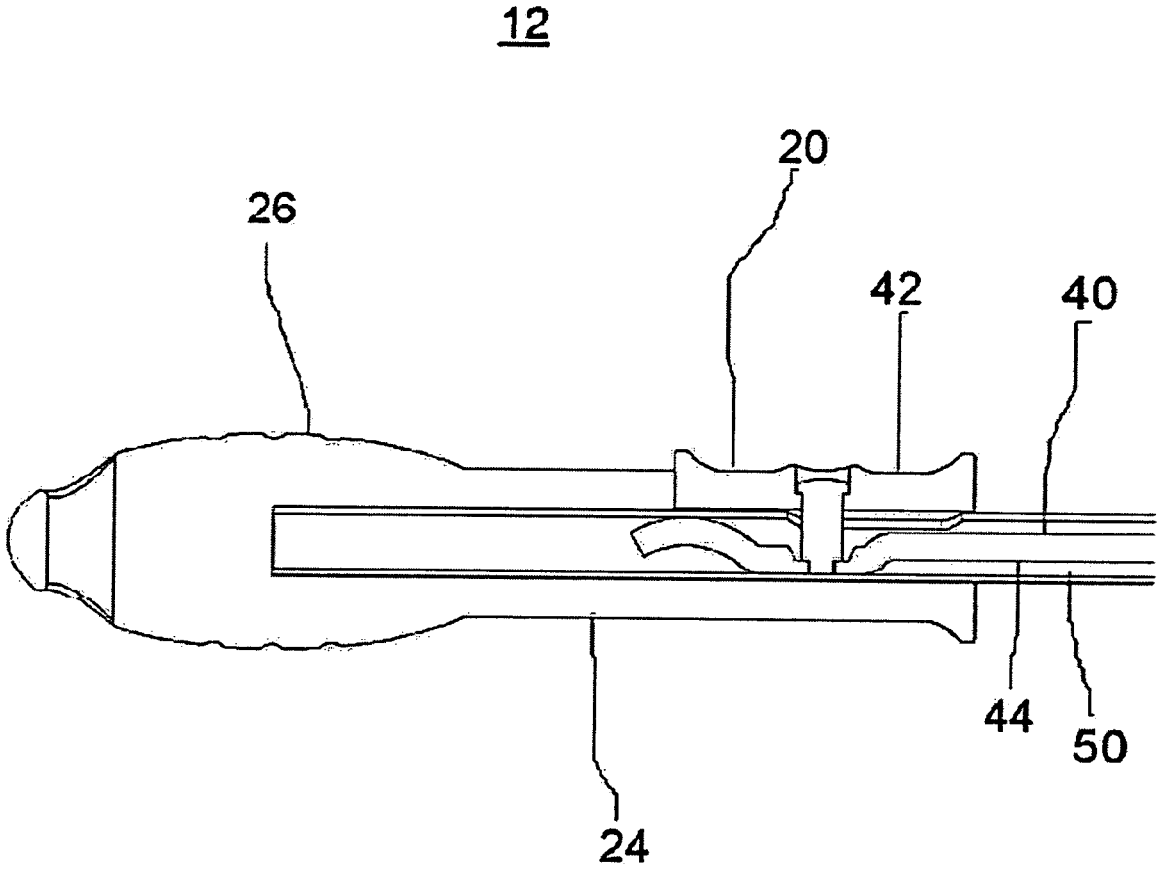
FIG. 4 is an axial cross-sectional view of the handle of the branding iron of FIG. 3.

Reference is now made to FIGS. 1 to 4. FIG. 1 is an isometric view of a branding iron 10 in a heating position that is constructed and operable in accordance with a preferred embodiment of the invention. FIG. 2 is an axial cross-sectional view of a handle arrangement 12 of branding iron 10 of FIG. 1 in a heating position. FIG. 3 is an isometric view of branding iron 10 of FIG. 1 in a branding position. FIG. 4 is an axial cross-sectional view of handle arrangement 12 of branding iron 10 of FIG. 3 in a branding position. Branding iron 10 is a personalized branding iron for branding items such as cooked meat and fowl. Branding iron 10 includes handle arrangement 12, a mounting arrangement 14, a plurality of unitary substantial symbols 16, a hinge pin 18 and a manual actuator 20.

Handle arrangement 12 has two ends 22, 24. End 24 is an elongated member. End 22 is a semicircular element having its center mechanically attached to one end of end 24. End 22 is mechanically connected to mounting arrangement 14. End 24 is terminated with an insulated handle 26. The term "mechanical connection" is defined herein as, mechanically connecting by any connection means, including welding. Additionally, the term "mechanically connected" is defined herein to include forming the two "mechanically connected" elements as a single unit.

Each symbols 16 is defined as "unitary" in that each symbol is a complete symbol prior to being connected to mounting arrangement 14. Each symbols 16 is defined herein as "substantial" in order to exclude a straight line. The term "symbol" is defined herein to include a character, picture, drawing, a letter of the alphabet, numeral or other symbol such as icons and logos. Each symbol 16 is configured as a metal symbol 28 disposed on a metal substrate 30. Each symbol 16 has a branding surface 32 raised above metal substrate 30. Symbols 16 are configured for branding. Mounting arrangement 14 and symbols 16 are configured for convenient reversible mechanical connection of symbols 16 to mounting arrangement 14. The convenient reversible mechanical connection is achieved by using hinge pin 18. This is described in more detail with reference to FIGS. 5 to 10. The term "convenient mechanical connection" is defined herein as connection without using heat (e.g. welding) or a chemical joining method (e.g. metal adhesive).

Hinge pin 18 is disposed through two holes 36 in mounting arrangement 14 and two holes 38 in handle arrangement 12 thereby connecting handle arrangement 12 and mounting arrangement 14. Hinge pin 18 has a hooked portion 34 for securing hinge pin 18 to end 24 of handle arrangement 12. Hinge pin 18 is described in more detail with reference to FIGS. 5 to 10. Mounting arrangement 14 is mechanically connected to end 22 of handle arrangement 12 using hinge pin 18, such that mounting arrangement 14 is able to swivel with respect to handle arrangement 12 between a "branding" position and a "heating" position. End 24 of handle arrangement 12 has a direction of elongation. Branding surfaces 32 of symbols 16 define a plane. In the "heating" position", the plane is parallel to the direction of elongation. In the "branding position", the plane is perpendicular to the direction of elongation. The mechanism for actuating the position of mounting arrangement 14 relative to handle arrangement 12 is described below.

Manual actuator 20 includes a lever arrangement 40 and an operating handle 42. Lever arrangement 40 extends from mounting arrangement 14 to end 24 of handle arrangement 12. Lever arrangement 40 is mechanically connected to mounting arrangement 14 and operating handle 42. Operating handle 42 is disposed in end 24 of handle arrangement 12 adjacent to insulated handle 26. Lever arrangement 40 includes a rod 44 and an element 48. One end of rod 44 is mechanically connected to operating handle 42. The other end of rod 44 is mechanically connected to element 48 by a hinge 46. Element 48 is mechanically connected to an off-center portion of mounting arrangement 14. Rod 44 is disposed within a hollow 50 of end 24 of handle arrangement 12. Therefore, lateral movement of operating handle 42 pushes or pulls rod 44 and element 48, thereby causing mounting arrangement 14 to turn. Therefore, manual actuator 20 is configured for moving mounting arrangement 14 between the "branding" position and the "heating" position. Therefore, when symbols 16 are being heated up on a fire, branding surfaces 32 of symbols 16 are face down in the fire (FIG. 1). Similarly, when a person wants to brand an item, the person pulls operating handle 42 back so that branding surface 32 of symbols 16 are perpendicular to the direction of elongation of end 24 of handle arrangement 12.

All the elements of branding iron 10 (including symbols 16) except for insulated handle 26 and operating handle 42 are typically formed from a metal such as stainless steel or iron. Symbols 16 are typically formed by a lost wax casting method. Insulated handle 26 and operating handle 42 are typically formed from an insulating material such as wood or a suitable plastic.

Figure 5:
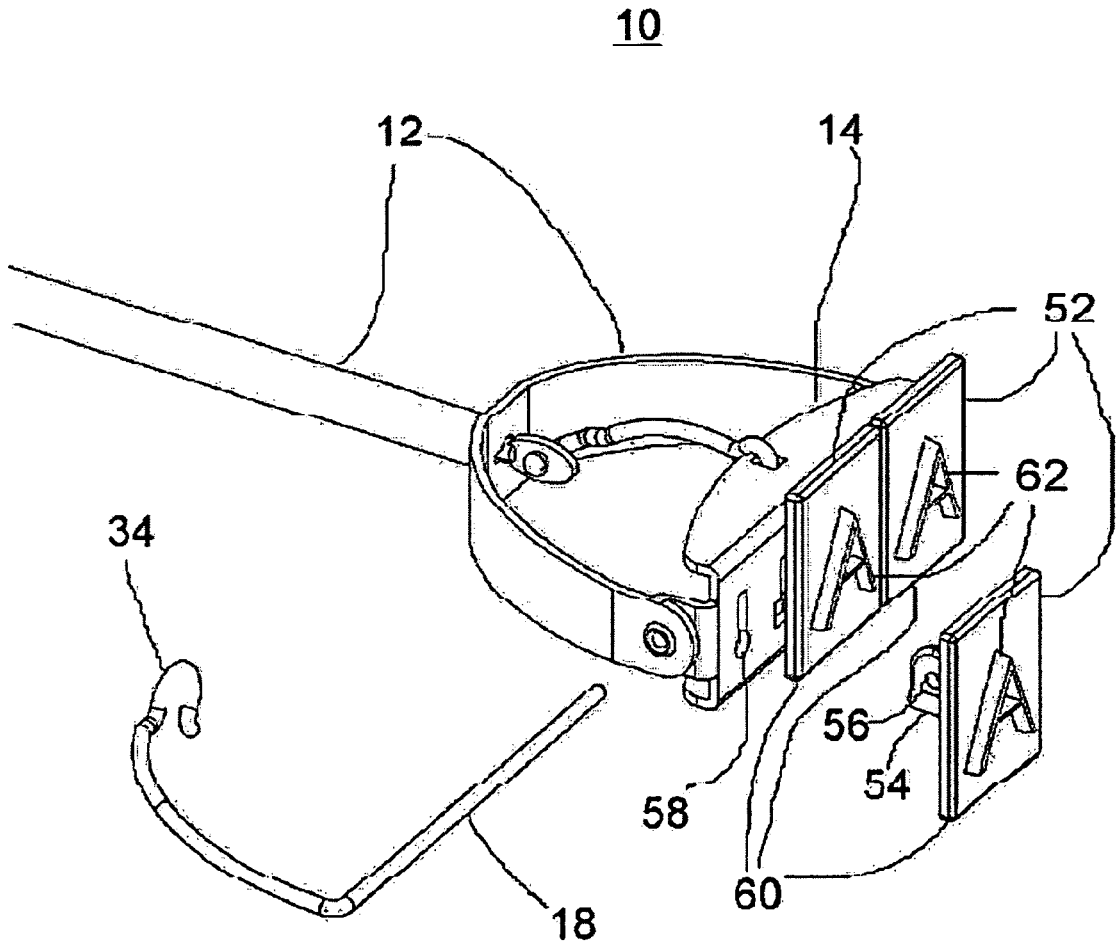
Figure 6:
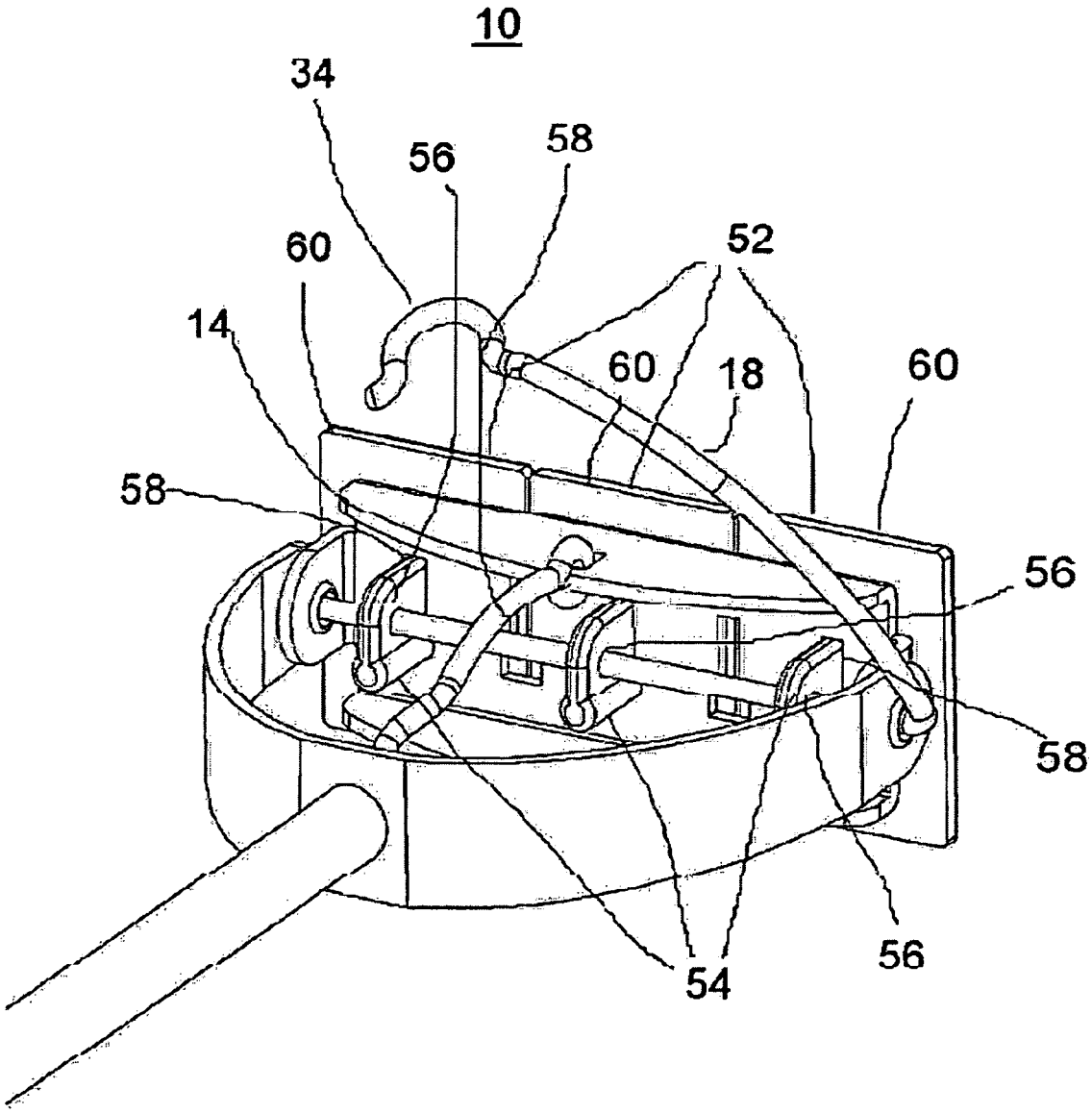
FIG. 6, is an isometric view of the mounting arrangement of FIG. 5 having a hinge pin inserted therein.

Reference is now made to FIGS. 5 and 6. FIG. 5 is an isometric view of mounting arrangement 14 of branding iron 10 of FIG. 3 having a plurality of letters 52 attached thereto. FIG. 6, is an isometric view of mounting arrangement 14 of FIG. 5 having hinge pin 18 inserted therein. Hinge pin 18 secures letters 52 to mounting arrangement 14 as well as securing mounting arrangement 14 to handle arrangement 12. Each letter 52 has a metal substrate 60 having a metal letter 62 disposed on one side and a mounting stem 54 disposed on the other side. Each mounting stem 54 has a hole 56 therein. Mounting arrangement 14 has a plurality of holes 58 therein. Mounting stem 54 and holes 58 are shaped such that letters 52 cannot be mounted upside down. Mounting stem 54 is inserted through one of holes 58. Once all letters 52 are inserted into holes 58, letters 52 are secured to mounting arrangement 14 by feeding hinge pin 18 through holes 56 of mounting stems 54. At the same time, mounting arrangement 14 is secured to handle arrangement 12 by hinge pin 18.

Figure 7:
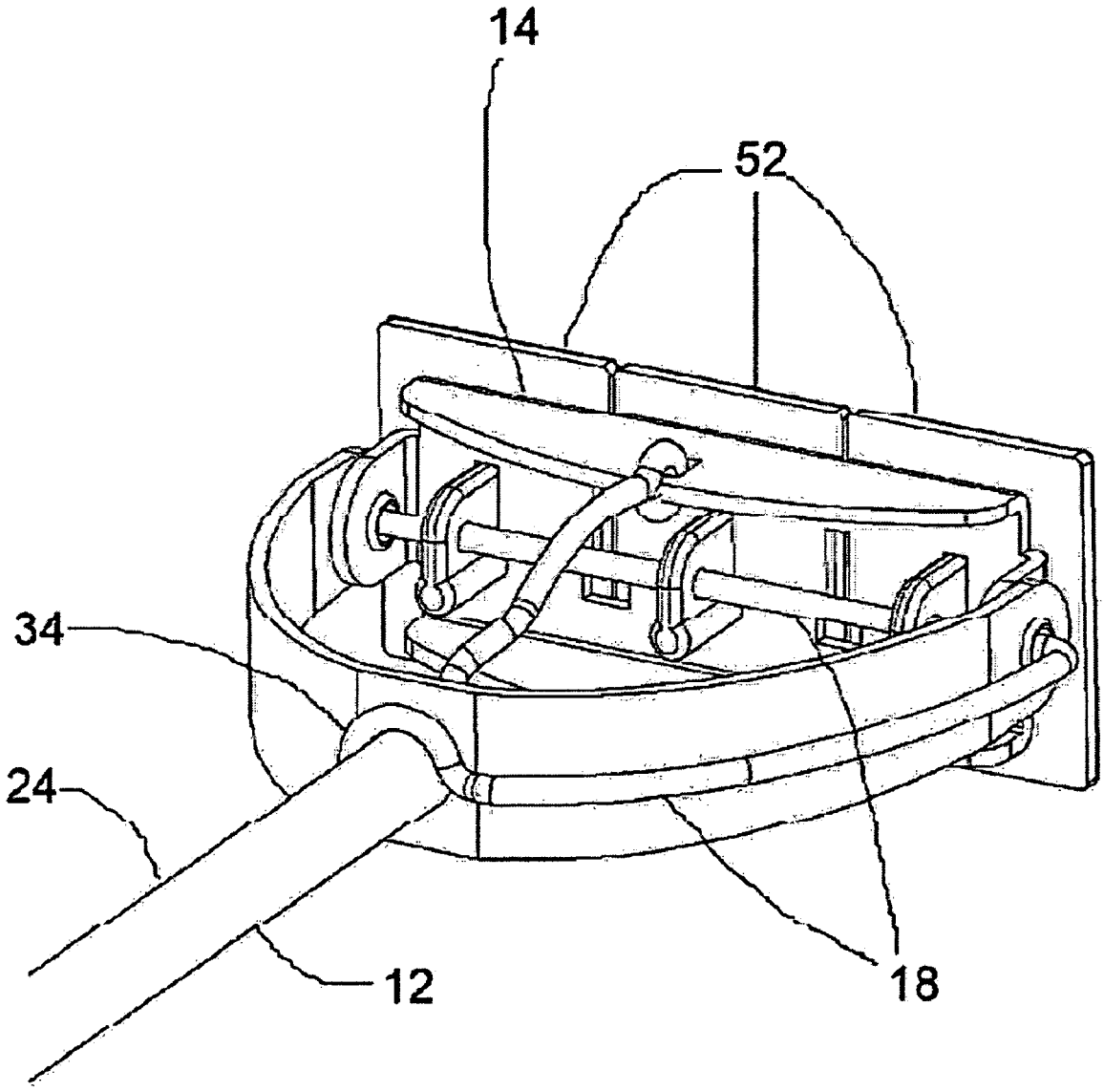
FIG. 7 is an isometric view of the mounting arrangement of FIG. 6 having the hinge pin secured thereon.

Reference is now made to FIG. 7, which is an isometric view of mounting arrangement 14 of FIG. 6 having hinge pin 18 secured thereon. Hooked portion 34 of hinge pin 18 is then secured around end 24 of handle arrangement 12 thereby securing hinge pin 18 in place. It will be appreciated by those ordinarily skilled in the art that symbols 16 (including letters 52) can be conveniently attached to mounting arrangement 14 using other convenient methods for example, but not limited to, bolting or pressure fitting symbols 16 to mounting arrangement 14.

Figure 8:
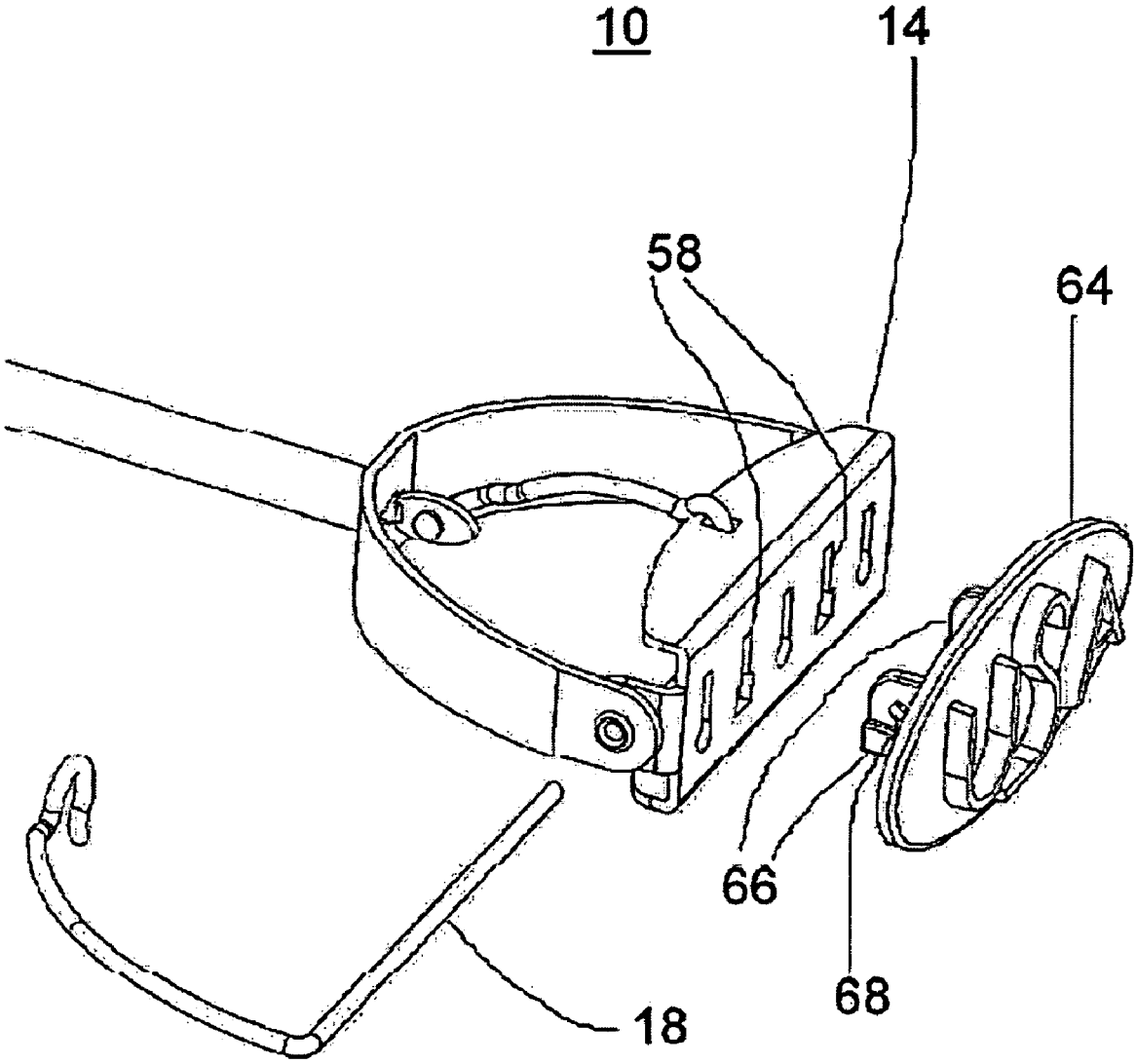
Figure 9:
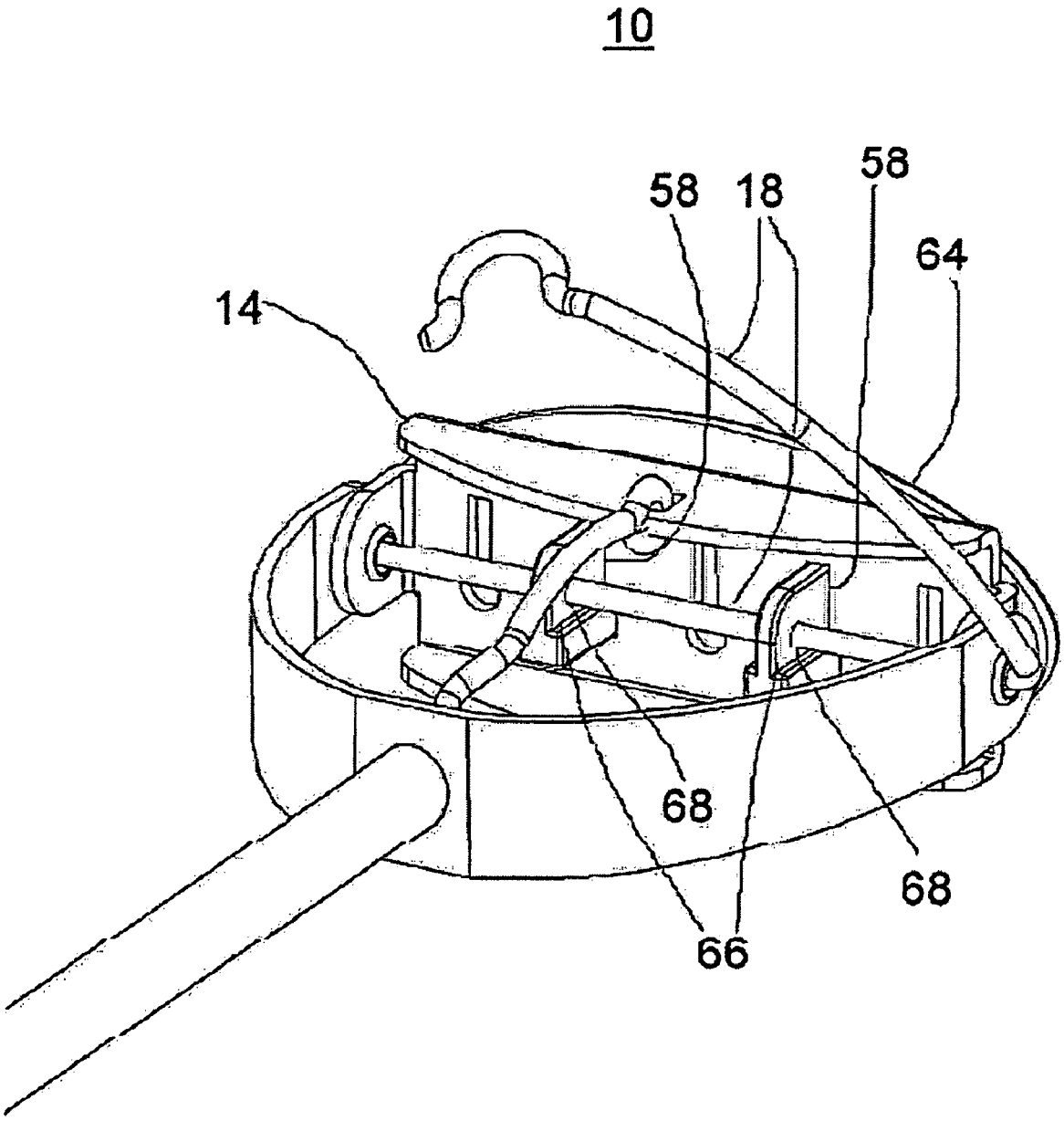
FIG. 9, is an isometric view of the mounting arrangement of FIG. 8 having a hinge pin inserted therein.
Figure 10:
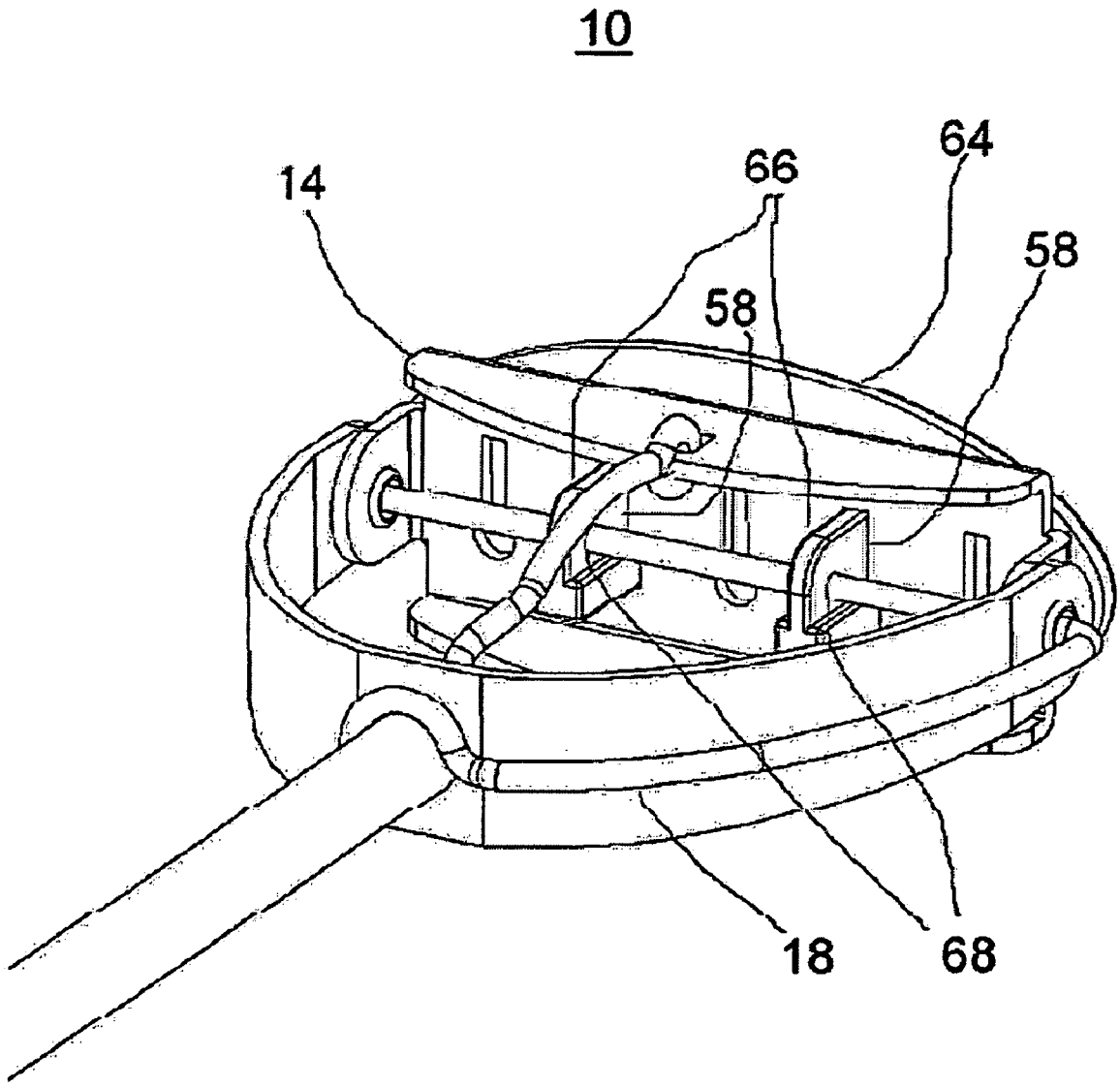
FIG. 10 is an isometric view of the mounting arrangement of FIG. 8 having the hinge pin secured thereon.

Reference is now made to FIGS. 8 to 10. FIG. 8 is an isometric view of mounting arrangement 14 of branding iron 10 of FIG. 3 having a symbol 64 attached thereto. FIG. 9, is an isometric view of mounting arrangement 14 of FIG. 8 having hinge pin 18 inserted therein. FIG. 10 is an isometric view of mounting arrangement 14 of FIG. 8 having hinge pin 18 secured thereon. The embodiment of shown in FIGS. 8 to 10 is substantially the same as the embodiments of FIGS. 5 to 7 except that letters 52 are replaced by a single symbol 64. Symbol 64 typically has two mounting stems 66 having holes 68 therein. Mounting stems 66 are then inserted into holes 58 of mounting arrangement 14. Symbol 64 is then secured to mounting arrangement 14 using hinge pin 18 which is fed through holes 68.

Figure 11:
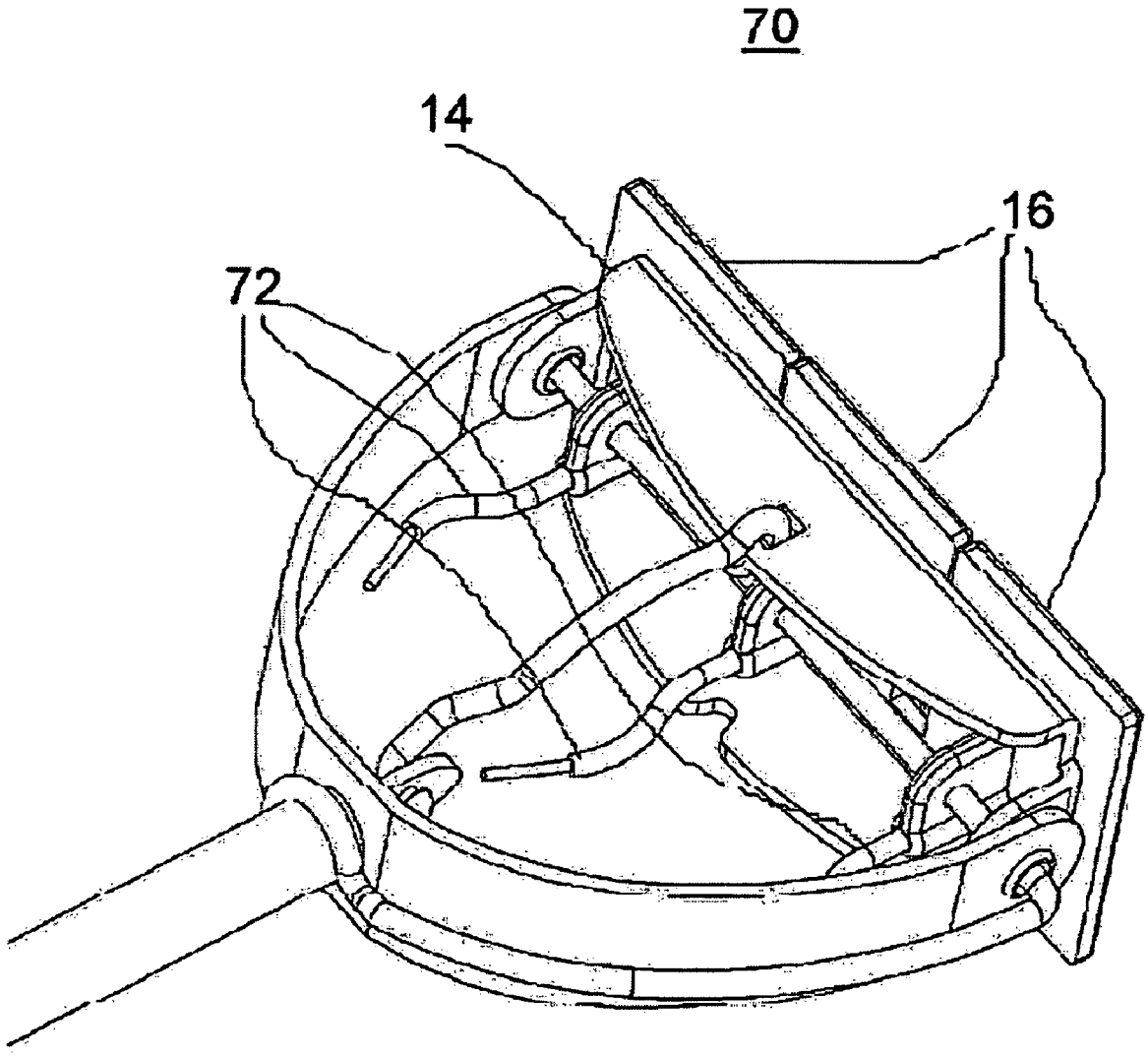
FIG. 11 is an isometric view of an electric branding iron that is constructed and operable in accordance with a preferred embodiment of the present invention.

Reference is now made to FIG. 11, which is an isometric view of an electric branding iron 70 that is constructed and operable in accordance with a preferred embodiment of the present invention. Electric branding iron 70 is substantially the same as branding iron 10 except that electric branding iron 70 includes an electric heating element 72 disposed adjacent to mounting arrangement 14, such that electric heating element 72 heats symbols 16.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

It will be appreciated by persons skilled in the art that the present invention is not limited to what has been particularly shown and described hereinabove. Rather, the scope of the present invention includes both combinations and sub-combinations of the various features described hereinabove, as well as variations and modifications thereof that are not in the prior art which would occur to persons skilled in the art upon reading the foregoing description.

What is claimed is:

1. A personalized branding iron, comprising:

(a) A handle arrangement having a first end and a second end;

(b) a mounting arrangement mechanically connected to said first end;

(c) at least one unitary substantial symbol configured for branding, said mounting arrangement and said symbol being configured for convenient mechanical connection of said symbol to said mounting arrangement:

(d) a manual actuator, wherein said mounting arrangement is mechanically connected to said first end of said handle arrangement such that said mounting arrangement swivels with respect to said handle between a branding position and a heating position, said manual actuator being mechanically connected to said handle arrangement mad said mounting arrangement, said manual actuator being configured for moving said mounting arrangement between said branding position and said heating position; and (e) wherein said handle arrangement has a direction of elongation, said symbol having a branding surface defining a plane, said plane being parallel to said direction of elongation in said heating position, said plane being perpendicular to said direction of elongation in said branding position.

2. The iron of claim 1, wherein said mounting arrangement and said symbol are configured for convenient reversible mechanical connection of said symbol to said mounting arrangement.

3. The iron of claim 1, further comprising an electric heating element disposed adjacent to said mounting arrangement, said electric heating element being configured for heating said at least one symbol.

4. The iron of claim 1, further comprising a pin for said convenient mechanical attachment of said symbol to said mounting arrangement.

5. The iron of claim 1, wherein said symbol is one of a letter or a numeral.

6. The iron of claim 1, wherein said manual actuator includes a lever arrangement extending from said mounting arrangement to said second end of said handle.

7. A branding iron, comprising:

(a) a handle arrangement having a first end and a second end;

(b) a mounting arrangement being configured for mechanical connection to at least one symbol for branding, said mounting arrangement being mechanically connected to said first end of said handle arrangement such that said mounting arrangement swivels with respect to said handle between a branding position and a heating position;

(c) a manual actuator mechanically connected to said handle arrangement and said mounting arrangement, said manual actuator being configured for moving said mounting arrangement between said branding position and said heating position; and (d) wherein said handle arrangement has a direction of elongation, said symbol having a branding surface defining a plane, said plane being parallel to said direction of elongation in said heating position, said plane being perpendicular to said direction of elongation in said branding position.

8. The iron of claim 7, further comprising an electric heating element disposed adjacent to said mounting arrangement, said electric heating element being configured for heating said at least one symbol.

9. The iron of claim 7, wherein said manual actuator includes a lever arrangement extending from said mounting arrangement to said second end of said handle.

10. A branding iron, comprising:

(a) a handle arrangement having a first end and a second end;

(b) at least one symbol configured for branding;

(c) a mounting arrangement mechanically connected to said symbol, said mounting arrangement being mechanically connected to said first end of said handle arrangement such that said mounting arrangement swivels with respect to said handle between a branding position and a heating position;

(d) a manual actuator mechanically connected to said handle arrangement and said mounting arrangement, said manual actuator being configured for moving said mounting arrangement between said branding position and said heating position; and (e) wherein said handle arrangement has a direction of elongation, said symbol having a branding surface defining a plane, said plane being parallel to said direction of elongation in said heating position, said plane being perpendicular to said direction of elongation in said branding position.

11. The iron of claim 10, further comprising an electric heating element disposed adjacent to said mounting arrangement, said electric heating element being configured for heating said at least one symbol.

12. The iron of claim 10, wherein said manual actuator includes a lever arrangement extending from said mounting arrangement to said second end of said handle.

* * * * *